US011812236B2

(12) United States Patent
Sha et al.

(10) Patent No.: US 11,812,236 B2
(45) Date of Patent: Nov. 7, 2023

(54) COLLABORATIVE DISTRIBUTED MICROPHONE ARRAY FOR CONFERENCING/REMOTE EDUCATION

(71) Applicant: EMC IP Holding Company LLC, Hopkinton, MA (US)

(72) Inventors: Danqing Sha, Shanghai (CN); Amy N. Seibel, Newton, MA (US); Eric Bruno, Shirley, NY (US); Zhen Jia, Pudong (CN)

(73) Assignee: EMC IP HOLDING COMPANY LLC, Hopkinton, MA (US)

( * ) Notice: Subject to any disclaimer, the term of this patent is extended or adjusted under 35 U.S.C. 154(b) by 0 days.

(21) Appl. No.: 17/451,834

(22) Filed: Oct. 22, 2021

(65) Prior Publication Data

US 2023/0129499 A1 Apr. 27, 2023

(51) Int. Cl.

| | |
|---|---|
| ***H04R 3/00*** | (2006.01) |
| ***G10L 21/0232*** | (2013.01) |
| ***H04R 1/40*** | (2006.01) |
| ***G10K 11/178*** | (2006.01) |
| *G10L 21/0216* | (2013.01) |

(52) U.S. Cl.

CPC ..... *H04R 3/005* (2013.01); *G10K 11/17823* (2018.01); *G10L 21/0232* (2013.01); *H04R 1/406* (2013.01); *G10K 2210/3044* (2013.01); *G10K 2210/3215* (2013.01); *G10L 2021/02166* (2013.01); *H04R 2201/401* (2013.01); *H04R 2410/01* (2013.01)

(58) Field of Classification Search

CPC .. H04R 3/005; H04R 1/406; H04R 2201/401; H04R 2410/01; G10K 11/17823; G10K 2210/3044; G10K 2210/3215; G10L 21/0232; G10L 2021/02166

USPC ..... 381/56, 58, 71.1, 92

See application file for complete search history.

(56) References Cited

U.S. PATENT DOCUMENTS

| | | | | |
|---|---|---|---|---|
| 9,986,360 | B1 * | 5/2018 | Aas | H04M 3/569 |
| 10,922,484 | B1 * | 2/2021 | Pereira | G06F 40/279 |
| 10,986,437 | B1 | 4/2021 | Pan et al. | |
| 11,245,993 | B2 | 2/2022 | Andersen et al. | |
| 11,404,073 | B1 | 8/2022 | Zhang | |
| 11,523,244 | B1 | 12/2022 | Meade et al. | |
| 2019/0008074 | A1 * | 1/2019 | Chen | G05D 23/1917 |
| 2019/0028803 | A1 | 1/2019 | Benattar | |
| 2019/0304431 | A1 * | 10/2019 | Cardinaux | G10K 11/17813 |
| 2019/0326989 | A1 * | 10/2019 | McElveen | H04R 3/005 |
| 2020/0145753 | A1 | 5/2020 | Rollow, IV | |
| 2021/0118462 | A1 | 4/2021 | Tommy et al. | |
| 2021/0136127 | A1 * | 5/2021 | Ghanaie-Sichanie | H04L 65/1069 |
| 2022/0060812 | A1 | 2/2022 | Ganeshkumar | |
| 2022/0060822 | A1 * | 2/2022 | Chng | B60W 60/0027 |
| 2022/0114995 | A1 | 4/2022 | Kuthuru et al. | |

(Continued)

FOREIGN PATENT DOCUMENTS

EP 3809410 A1 4/2021

*Primary Examiner* — William A Jerez Lora

(74) *Attorney, Agent, or Firm* — Workman Nydegger

(57) ABSTRACT

A collaborative distributed microphone array is configured to perform or be used in sound quality operations. A distributed microphone array can be operated to provide sound quality operations including sound suppression operations and speech intelligibility operations for multiple users in the same environment.

20 Claims, 5 Drawing Sheets

(56) References Cited

U.S. PATENT DOCUMENTS

| | | | | |
|---|---|---|---|---|
| 2022/0142600 | A1* | 5/2022 | Tefft | H04R 29/008 |
| 2022/0236946 | A1* | 7/2022 | Khosrowpour | G06F 3/165 |

* cited by examiner

COLLABORATIVE DISTRIBUTED MICROPHONE ARRAY FOR CONFERENCING/REMOTE EDUCATION

FIELD OF THE INVENTION

Embodiments of the present invention generally relate to sound quality operations, which include distributed microphone array operations. More particularly, at least some embodiments of the invention relate to systems, hardware, software, computer-readable media, and methods for improving noise suppression and speech intelligibility at least with respect to online activities including conference calls and remote learning.

BACKGROUND

Opportunities to communicate using the Internet are increasing. More people are working from home and education is being conducted remotely, for example. These communications require the use of various collaboration tools. For conference calls such as those used for education and work, the effectiveness of the call often depends on the quality of the audio and the ability of users to hear the audio, which is also impacted by background noise in the users' environments. When employees or students cannot hear, productivity and effectiveness decrease. More specifically, the speech conveyed in many conference calls is often inadequate. For example, background noise, interfering voices, and other noise (on both sides of the call) can interfere with speech intelligibility.

Problems understanding speech can occur in small environments with a single user. When there are many interfering voices or larger background noises, the ability to clearly hear the intended speech is even more difficult. This is particularly true when multiple users are in the same room and/or for persons with hearing loss. Background noise is also a challenge for people that are easily distracted or have to work/learn in noise environments. Although a person could wear headphones, many studies show that many users do not want to wear headphones for a variety of reasons, including the fact that the headphones are not comfortable, particularly when wearing the headphones for longer periods of time.

Laptop users are a prime example of users that often experience difficultly hearing during conference calls. Laptops are unable to effectively suppress unwanted signals in the environment including noise. Further, there is no collaboration between laptops that are in the same environment with regard to noise suppression and speech intelligibility. Systems and methods are needed to improve the ability of a user to hear desired sounds from a device and minimize background noise within their environment.

BRIEF DESCRIPTION OF THE DRAWINGS

In order to describe the manner in which at least some of the advantages and features of the invention may be obtained, a more particular description of embodiments of the invention will be rendered by reference to specific embodiments thereof which are illustrated in the appended drawings. Understanding that these drawings depict only typical embodiments of the invention and are not therefore to be considered to be limiting of its scope, embodiments of the invention will be described and explained with additional specificity and detail through the use of the accompanying drawings, in which.

DETAILED DESCRIPTION OF SOME EXAMPLE EMBODIMENTS

Figure 1A:
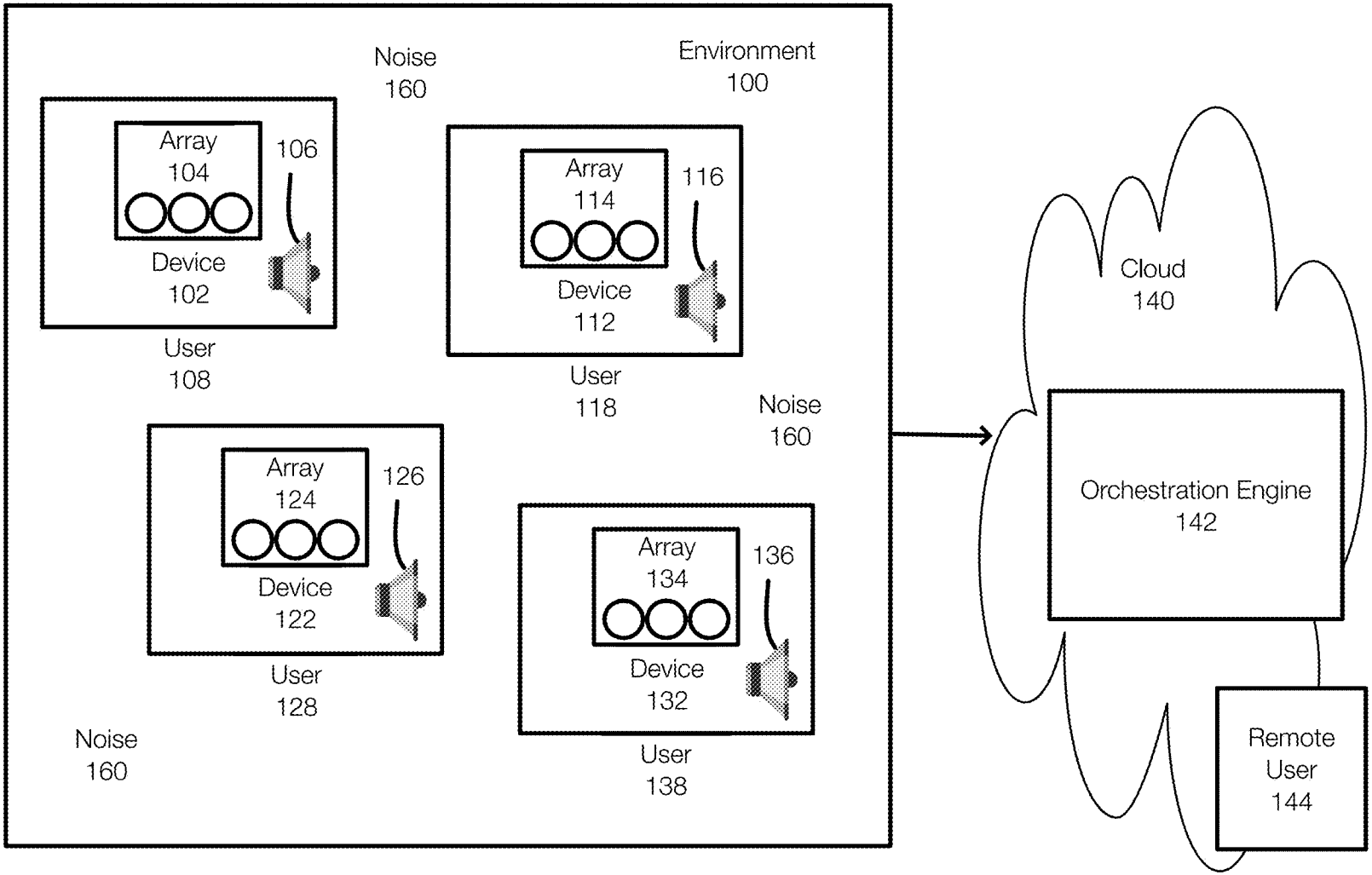
FIG. 1A discloses aspects of multiple users and multiple devices operating in an environment in which sound quality operations are performed.

Embodiments of the present invention generally relate to sound quality operations and microphone array related operations. More particularly, at least some embodiments of the invention relate to systems, hardware, software, computer-readable media, and methods for performing sound quality operations including noise suppression and speech intelligibility operations.

In general, example embodiments of the invention relate to controlling microphone arrays in order to suppress environment noise and improve speech intelligibility. Embodiments of the invention are configured to aid users hear desired signals while suppressing undesired signals that may interfere with the desired signals. Embodiments of the invention are configured to perform these functions using multiple microphone arrays associated with multiple devices, including devices in the same environment or room.

Embodiments of the invention allow distributed microphone arrays to collaborate together for performing sound quality operations including sound source detection, sound source localization, noise suppression, speech intelligibility, and the like. In an environment that includes multiple users using corresponding devices, embodiments of the invention can mask noise or interfering sound for each user, highlight or enhance desired speech sounds from each device's speakers or other desired signal, increase the volume of relevant sounds over undesired sounds, and provide real time situational awareness. This allows each user to focus on speech from their device without wearing headsets, even in noisy environments.

By way of example, an orchestration engine receives sound information from multiple microphone arrays. The orchestration engine can process the sound information to determine the best settings for each device in the environment. Each device can recognize other devices in the same network and this facilitates the ability to collaborate.

During collaboration, and in addition to suppressing noise and enhancing speech, an indication (e.g., visual, audial, haptic) or suggestion may be provided that suggests the best manner in which to align or arrange the devices (e.g., the device, the device's speaker, the device's microphone array) in the environment. The processing performed by the orchestration engine may include or use machine learning models and may be offloaded from the arrays or the corresponding devices. The processing may also be offloaded to an edge or cloud server.

The microphone arrays can integrate with each other using various networks including wireless networks, cellular networks, wired networks, or combination thereof. Embodiments of the invention can improve sound quality operations using existing hardware to help persons working or learning in noisy environments.

Embodiments of the invention are discussed in the context of multiple users and devices in the same environment. Embodiments of the invention, however, can also be applied to a single device. Embodiments of the invention are further discussed in the context of conference calls. In a conference call, the desired signal or sound for a user is speech from other users in the call that are emitted by the speakers of the user's device. The undesired signal or sound is generally referred to as background noise, which may include speech of other users in the environment, reverberations, echoes, or the like or combination thereof.

By way of example only, noise that typically damages speech intelligibility includes random noise, interfering voices, and room reverberation. In a room full of devices, each including a microphone array, embodiments of the invention are able to collect sound information from each of the microphone arrays. In other words, the sounds sensed by the microphone arrays is output as sound information.

The collected information can be merged or fused by an orchestration engine. The orchestration engine can then process the sound information to generate control signals or adjustments that can be implemented at each of the microphone arrays or at each of the devices. The adjustments can be specific for each microphone array or device. In addition, each device, based on the adjustments, may be able to generate an anti-noise signal to cancel the noise or undesired signals at each device. Thus, each device may generate a different anti-noise signal because the noise from the perspective of one device is different from noise from the perspective of the devices. For example, background noise originating in a corner of the room will arrive at the various devices at different times. Thus, different anti-noise signals may be needed for each of the devices. In effect, noise at each device in a room can be suppressed such that the speech intelligibility for each user is improved.

Embodiments of the invention may be implemented in different scenarios. For example, a conference call may occur where some users are in the same room communicating with one or more remote users (who may also be in the same room). Alternatively, all of the users may be in the same room (e.g., a classroom). In these environments, the participating devices in each room and/or their microphone arrays and/or other microphone arrays that may be in the environment may coordinate together to reduce or suppress background noise and enhance speech or other desired signal.

FIG. 1A discloses aspects of a distributed microphone array operating in an environment. The environment 100 may be a room, a classroom or other location. In this example, multiple users, represented by users 108, 118, 128, and 138 are present in the environment 100. The users 108, 118, 128, and 138 are associated, respectively, with devices 102, 112, 122, and 132. Thus, the user 108 may be participating in a conference call that includes the other users 118, 128, and 138 and/or remote users, represented by the remote user 144.

The device 102 includes a microphone array 104 and a speaker 106. The devices 112, 122 and 132 are similarly configured with arrays 114, 124, 134 and speakers 116, 126, and 136. The arrays 104, 114, 124, and 134 can be connected or associated with each other to form a distributed microphone array. The distributed array, for example, may thus be present on the same network. Because the devices may be movable, the locations of the arrays in the distributed array may change over time, even during a specific call or session. In one embodiment, the array 104 (or an array in the environment) may include one or more microphones. The array 104 may also include multiple arrays, each of which may include one or more microphones.

During the conference call or in a classroom, speech from the speaker 106 is intended for the user 108. Similarly, speech from the speakers 116, 126, and 136 are intended, respectively, for the users 118, 128, and 138.

The array 104 may collect sound information from the environment 100. By way of example, the array 104 may collect background noise, which may include reverberations, traffic, other noise, speech from the users 118, 128, and 138, speech of the remote user 144 emitted from the speakers 116, 126, and 136 in the environment 100. The array may also capture a desired signal—the speech from the user 108. The array 104 can be configured to cancel, reduce, or suppress the interfering speech from the users 118, 128, 138 or sound emitted by the speakers 116, 126, and 136 while enhancing speech from the user 108 that is transmitted to other users participating in the call.

The microphones arrays 104, 114, 124, and 134 collect sound information from the environment and provide the sound information to an orchestration engine 142 in the cloud or at the edge. The orchestration engine 142 processes the sound information from the arrays 104, 114, 124, and 134 and generates insights that can be used to generate adjustments. The processing may include sound localization, sound extraction, noise-speech separation, and the like. The processing may also include identifying desired signals or sound sources. The orchestration engine 142 can provide individual adjustments to each of the arrays 104, 114, 124, and 134 and/or to each of the devices 102, 112, 122, and 132.

The orchestration engine 142 allows the noise 160 (undesired speech, reverberations, echoes, other background noise) to be cancelled (or suppressed or reduced) from the perspective of each device and each user. As a result, the adjustments provided to the device 102 or the array 104 and the anti-noise signal output by the speaker 106 may differ from the adjustments provided to the device 112 or the array 114 and the anti-noise signal output by the speaker 116. Thus, adjustments generated by the orchestration engine 142, which are based on sound detected by the distributed microphone arrays and provided to the orchestration engine 142 as sound information, can be customized for each of the devices in the environment 100.

More specifically, the orchestration engine 142 can receive sound information and determine optimal settings for each participating device and each microphone array. The orchestration engine 142 can create a sound map of the environment 100 to identify and locate all of the sound sources, separate speech from noise, highlight the most important sound/sound source for each user as well as identify noise/interfering voices for each user.

The devices 102, 112, 122, 132 can be linked, in one example, by creating an account and setting preferences. Through the account, the arrays/devices can be detected and linked together in the same network. An administrator may also be able to link the devices or the relevant arrays on behalf of users in the network.

In addition, the users 108, 118, 128 and 138 can provide feedback to the orchestration engine 142. The orchestration engine 142 may also be configured to detect deteriorating sound quality automatically. This allows the orchestration engine 142 to generate or recommend array and/or device settings based on situational awareness (e.g., analysis of the current sound information) and/or user feedback. Each microphone array can make adjustments based on the orchestration engine's commands to ensure the best quality audio for each user. The orchestration engine can identify and separate noise from speech for each user and provide information that allows each device to generate an appropriate anti-noise signal. In addition, the microphone arrays, based on adjustments from the orchestration engine, can perform dereverberation, echo cancellation, speech enhancement, and beamforming or other sound quality operations in order to provide each user with improved speech intelligibility. Each user will hear a mix of speech from other users (e.g., the remote user 144) with reduced or filtered background noise.

In addition to reducing or filtering the noise in the environment, the desired speech delivered through the devices to the users may be enhanced at the source. Thus, the microphone array associated with the remote user 144 may be used to process the speech of the remote user 144 to remove background noise therefrom. Thus, the speech heard by the user 108, for example, is the speech desired to be heard. Undesired speech is reduced or filtered.

Figure 1B:
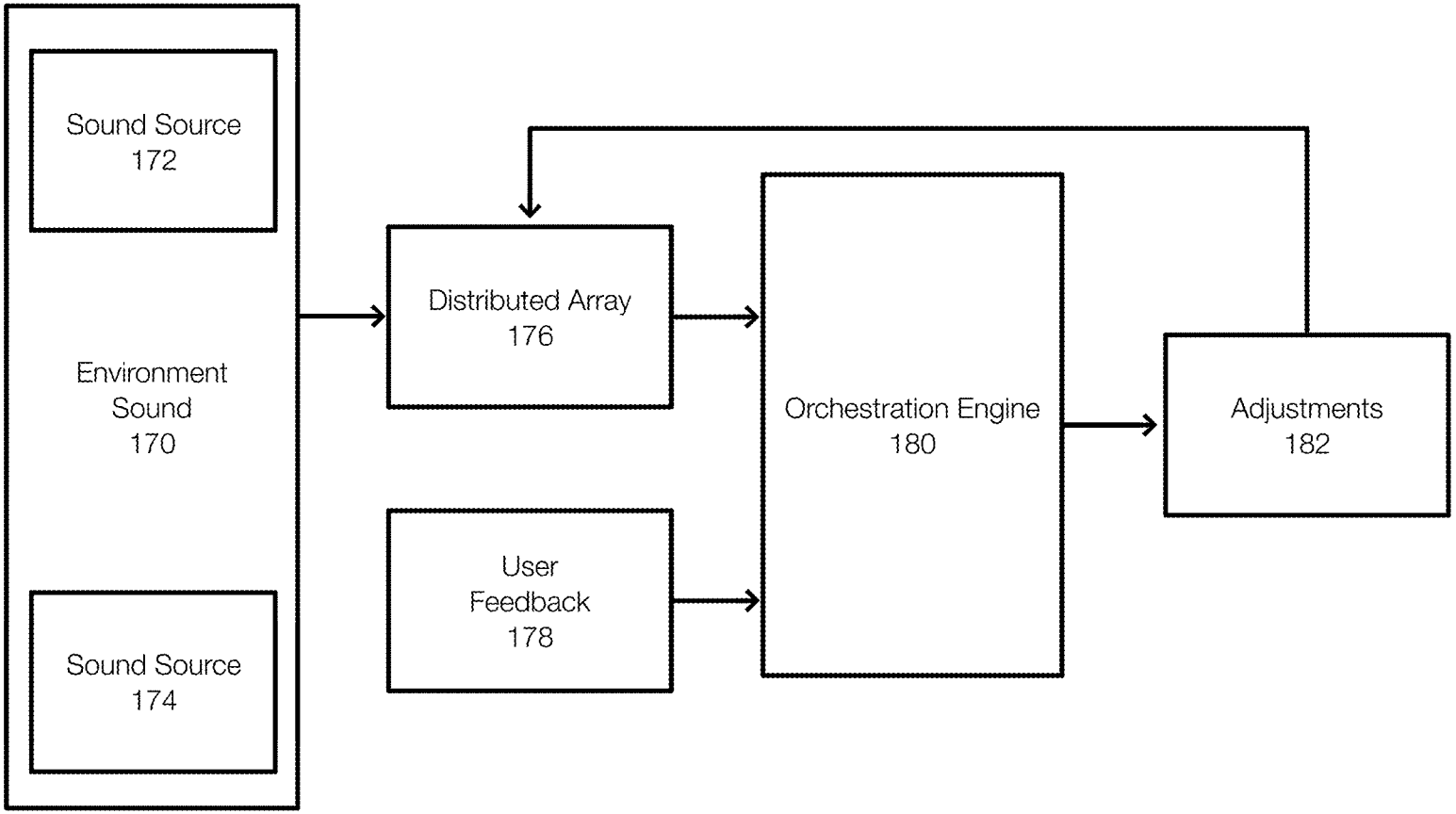
FIG. 1B discloses aspects on an orchestration engine configured to improve noise suppression and speech intelligibility in an environment.

FIG. 1B illustrates an example of an orchestration engine. In FIG. 1B, the distributed array 176 may receive sound from sound sources 172 and 174 or, more generally, environment sound 170. The output of the distributed array 176 is sound information that is received by the orchestration engine 180. The orchestration engine 180 processes the sound information, for example with a machine learning model, to separate the sound sources, localize the sound sources, identify which of the sound sources should not be suppressed, and the like. The processing generates adjustments 182 that are then applied to the microphone arrays in the distributed array 176. The orchestration engine 180 may also incorporate user feedback 178 into generating the adjustments 182. For example, a user associated with a microphone array may indicate that there is too much background noise. The orchestration engine 180 may generate an adjustment 180 to further reduce or suppress the background noise for that user. Other feedback 178 from other users may be handled similarly.

Figure 2:
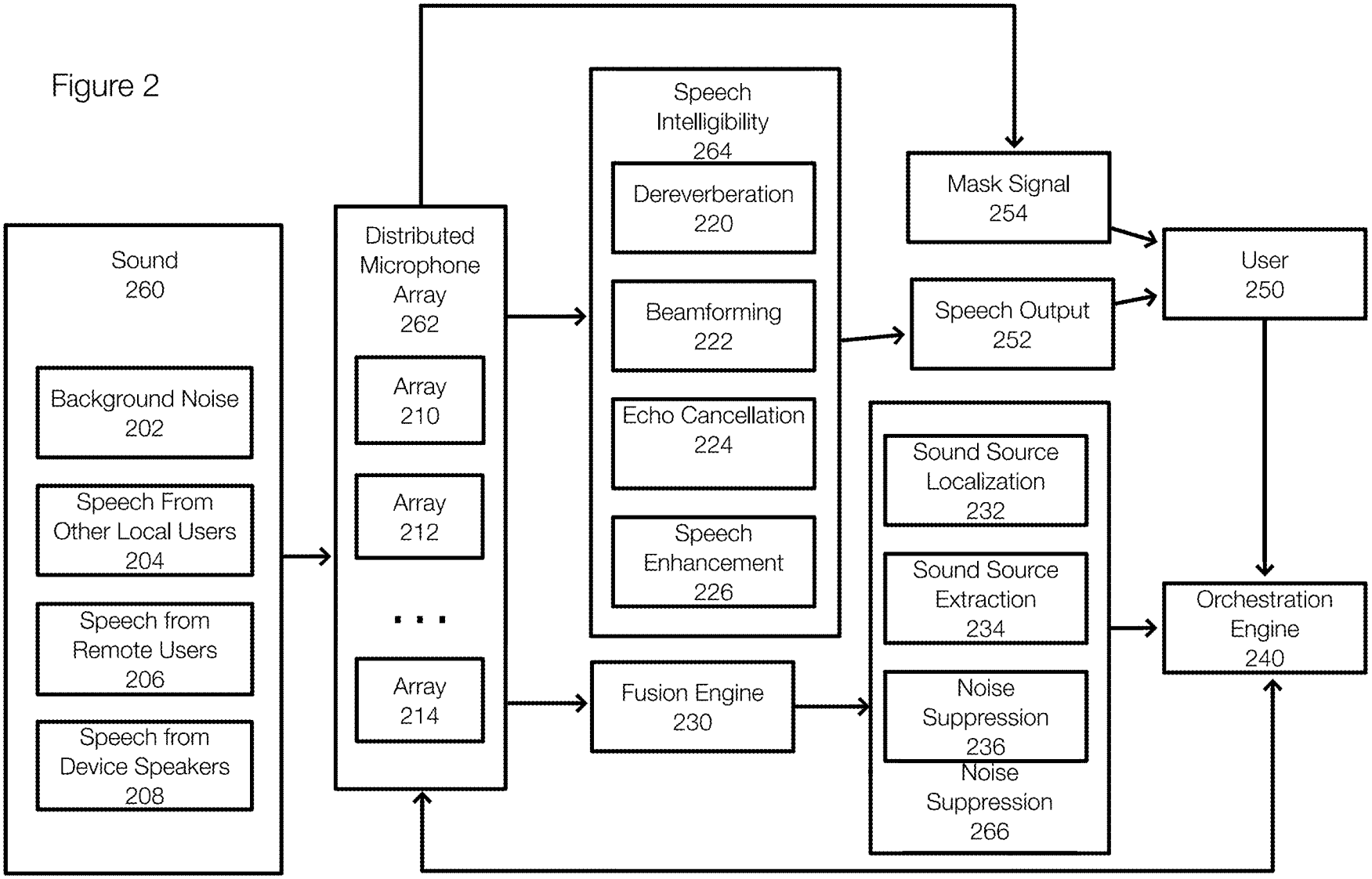
FIG. 2 discloses aspects of suppression noise and enhancing speech intelligibility in a crowded environment.

FIG. 2 discloses aspects of an architecture for performing sound quality operations in an environment including a distributed microphone array. FIG. 2 illustrates a distributed microphone array 262, represented by individual arrays 210, 212 and 214. Each of the individual arrays 210, 212 and 214 may be associated with a specific device. Some of the arrays 210, 212, and 214 may be separated from the devices. The distributed array 262 is typically present in the same environment such that any noise or sound in the environment may be detected by each of the individual arrays 210, 212, and 214.

The sound 260 detected by the distributed array 262 includes generally background noise and speech. However, these general categories may include background noise 202, speech from other local users 204, speech from remote users 206, speech from device speakers, and the like. The sound information collected or received by the distributed array 262 can be used for speech enhancement 264 and by a fusion engine 230, which may be part of an orchestration engine 240.

Embodiments of the invention operate to improve the speech of a user transmitted to other users and to improve the speech heard by the users. Speech intelligibility 264 is often performed such that a user's speech is improved at the time of transmission. Each of the microphone arrays in the environment may perform dereverberation 220, beamforming 222, echo cancellation 224, and speech enhancement 226. The distributed microphone array 262 can be adjusted, by the orchestration engine 240, to improve the intelligibility of a user's speech.

The fusion engine 230 receives an output of the distributed array 262. The fusion engine 230 can process the sound information from the distributed array 262 to perform sound source localization 232, sound source extraction 234, noise suppression 236, noise/speech separation, or the like. By localizing and extracting sound sources, the signals needed to cancel specific sound sources can be performed.

For example, music may be playing in an environment. Each of the arrays 210, 212 and 214 may detect the music. The fusion engine 230 can use the sound information from the distributed array 262 to localize the location of the sound source 232 and extract the sound source 234 from the sound information. The sound source can then be suppressed 236 by the system orchestrator 240 controlling the microphone array 262 and/or by allowing a mask signal 254 to be generated to mask or cancel the sounds identified as noise. The mask or anti-noise signal may, rather than cancel, reduce or lessen or filter the sound identified as noise.

By localizing and extracting noise, sounds that should not be suppressed can be localized and enhanced. Returning to FIG. 1, the orchestration engine 240 can determine that the speech of the user 108 can be identified as a sound source. The orchestration engine 240 can determine that the array 104 at the device 102 should not be configured to cancel the user's speech. Further, speech from a remote user received at the device and output by the speaker 106 should not be suppressed. However, the speech of the user 108 should be reduced of filtered by the arrays of other devices in the environment 100.

In this manner, the user 250 is able to hear speech from other users emitted by speakers associated with the user 250 while noise from the perspective of the user 250 is suppressed. The orchestration engine 240 can coordinate the commands or adjustments for all arrays/devices such that sound quality for each user is managed and enhanced.

Figure 3:
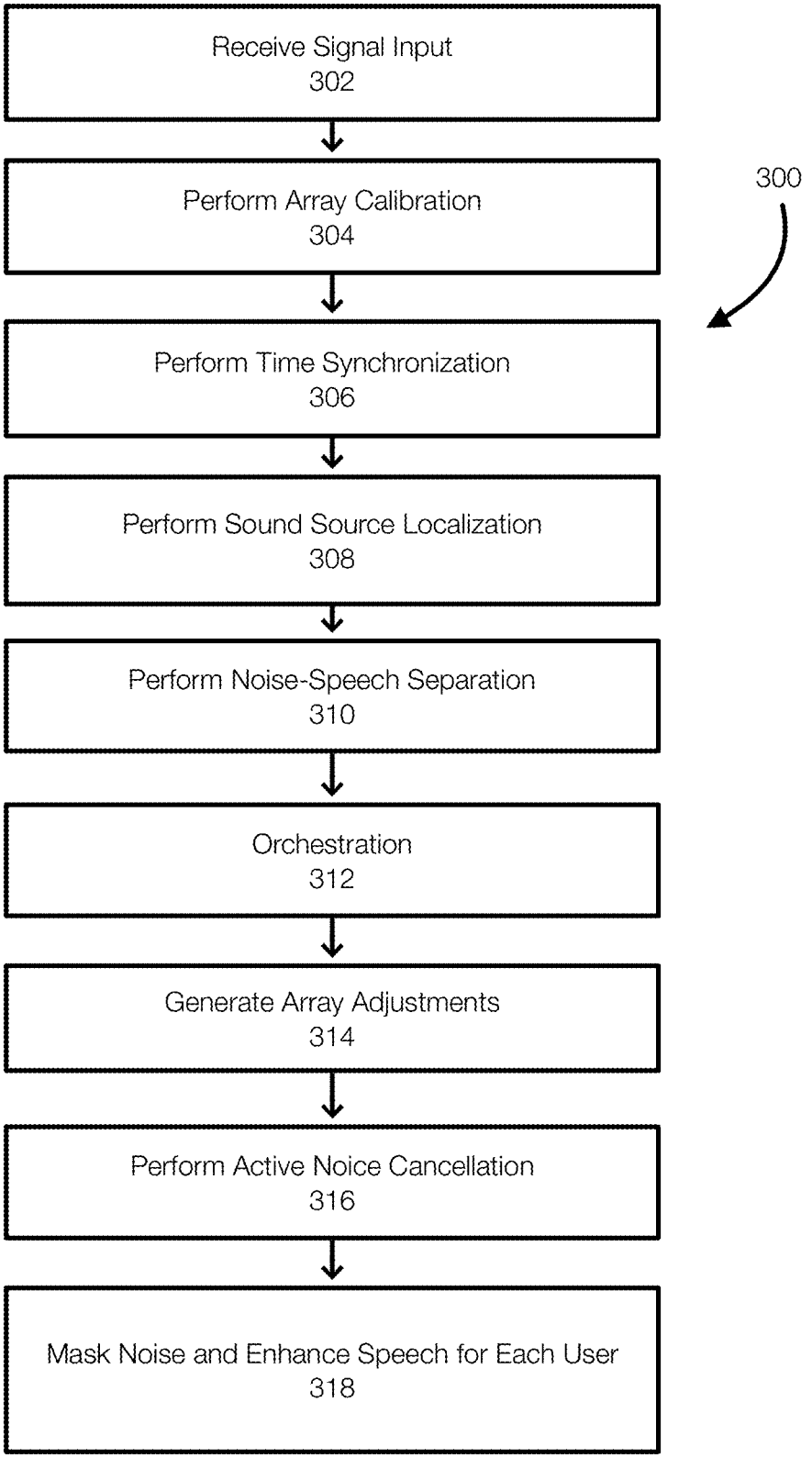
FIG. 3 discloses aspects of sound quality operations using distributed microphone arrays.

FIG. 3 discloses aspects of a method for performing sound quality operations. Initially, signal input is received 302 into the distributed microphone array and the microphone arrays in the distributed array are calibrated 304. The arrays may be calibrated by using joint source and microphone localization methods that may incorporate matrix completion constrained by Euclidean space properties. The calibration may be performed once or periodically and may not be repeated as often as other aspects of the method 300.

Next, the signals received as input to the distributed array are synchronized 306. Synchronization allows the distributed microphone array to account for different types of delays including internal microphone array delays, time of arrival (TOA) delays, onset time delays, and the like. Synchronization ensures that the sound information, which is received by the individual arrays at different times, is synchronized and ensures that any adjustments made to the arrays are based on synchronized sound information. For example, test packet(s) can be sent to participants to determine round trip time (RTT). This information can also be used as input to coordinate or account for any delays or to coordinate delays.

Next, sound source localization 308 is performed. The distributed microphone array performs sound source localization, which may include creating a sound map. The sound map may identify sound sources in the environment as well as characteristics of the sound sources such as type (speech, music, traffic, etc.), loudness, directionality, or the like. Noise and speech may then separate 310 for each of the microphone arrays using, for example, the sound map or using the sound localization.

The orchestration engine next performs orchestration 312. Orchestration includes fusing or combining all of the sound information from the individual microphone arrays and making decisions regarding the settings for each microphone array in the distributed array. The microphone adjustments 314 are then implemented such that noise cancellation 316 (noise reduction) is performed at each device and for each user. Noise cancellation, suppression or reduction may include generating an anti-noise signal, which may be different at each device. In addition to noise reduction, speech enhancement 318 is also performed such that the speech of each user that is transmitted to other users via the call, is enhanced. As previously stated, speech viewed as noise, which is the speech that may interfere with hearing the intended speech, may be reduced by the noise masing. Thus, noise masking and speech enhancement 318 for each user is performed.

As additional sound information is received, at least some elements of the method 300 are repeated. More generally, many of the elements in the method 300 are repeated continually or as necessary. Because sound is continually being created, most elements of the method 300, except for calibration 304, may be repeated. This allows the orchestration engine performing orchestration 312 to adapt to changes in the sounds in the environment.

The orchestration engine may include machine learning models that are configured to generate the settings. The machine model can be trained using features extracted from sound information, room models, acoustic propagation, and the like. Once trained, sound information from the environment or received from the distributed array, along with other inputs, are input to the machine learning model and insights such as settings may be generated.

Sound source localization may be performed using direction of arrival, time difference of arrival, interaural time difference, head-related transfer function, deep based learning, or the like. Sound source separation may be performed using blind source separation based on principal component analysis and independent component analysis. Sound source separation may also be performed using a beamforming based approach including a deterministic beamformer and a statistically optimum beamformer.

The orchestration engine may use these algorithms to generate a sound map, separate speech and noise, and generate anti-noise for each device to mask or reduce noise in each user's vicinity. The orchestration engine fusions all the data or sound information from the distributed array and makes decisions about settings for each microphone array.

As previously stated, the orchestration engine may include machine learning models. The input to the machine learning model may include a real time sound map within the room to identify all of the sound/noise sources and highlight the most important sound for each user, as well as noises and interfering voices, including the location of each sound/noise source and an SPL for each sound/noise source.

During training, the machine learning model separates unwanted sounds/noise from wanted sounds (speech), and learns to output: directivity of each microphone array to be adjusted and anti-noise level to be generated for each microphone array in the loop. Example machine learning models include classification, regression, generative modeling, DNN, CNN, FNN, RNN, reinforcement learning, or combination thereof.

The performance of the orchestration engine can be evaluated objectively and subjectively. For objective evalution, the following metrics may be used to measure the noise suppression effects: PESQ (perceptual evaluation of speech quality), STOI (short-time objective intelligibility), Frequency-weighted SNR (signal-noise ratio).

For subjective evaluation, user feedback may be used. The feedback can be compared to threshold levels or requirements. Adjustments to the arrays can be made until the thresholds are satisfied.

If there are numerous microphone arrays in the distributed array and all arrays are on and tracking, the processing requirements may become large. As a result, it may be possible to limit the number of arrays used in the distributed array. This may improve the response of the system, promote and facilitate data fusion, and make optimizations more effectively.

Advantageously, embodiments of the invention can control both the number of microphone arrays in the distributed array as well as the pattern or shape of each individual array. The adjustments may by the orchestration engine may include changes to the number of arrays, changes to the individual array patterns, controlling the status of individual microphones, controlling the algorithms implemented at the arrays, changing array parameters, or the like or combination thereof.

By continually assessing the spectral, temporal, level, and even angular input characteristics of each user's communication environment, the number of microphone arrays to form distributed microphone array, and appropriate features for each array such as directions, shapes, number of microphones can be adapted to optimize the noise suppression and speech enhancement for each user.

In one example, an indication (visual, audio, haptic, etc.) of how to align the devices, like speakers, may be provided for the best results. This could be applied for either an individual's setup if multiple speakers were involved, or for all primary devices in a network. For example, the location/facing direction of microphone array or of a speakers could be adjusted by the user based on the received indication.

The orchestration engine is configured to help control latencies, which is often critical in voice communications. Longer latencies are often annoying to end users. Latency is typically impacted by network, compute, and codec. The network latency is typically the longest.

Because processing resources of the individual microphone arrays are typically smaller than the connected device, the required computations can be offloaded to the laptops or user devices, to edge servers, to cloud servers or the like. This can reduce the computation load of the microphone arrays. At the same time, latencies are controlled. The computational workload may be dynamically distributed or adjusted in order to ensure that the latency is managed.

Embodiments of the invention, such as the examples disclosed herein, may be beneficial in a variety of respects. For example, and as will be apparent from the present disclosure, one or more embodiments of the invention may provide one or more advantageous and unexpected effects, in any combination, some examples of which are set forth below. It should be noted that such effects are neither intended, nor should be construed, to limit the scope of the claimed invention in any way. It should further be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should any such embodiments be construed to implement, or be limited to implementation of, any particular technical effect (s) or solution(s). Finally, it is not required that any embodiment implement any of the advantageous and unexpected effects disclosed herein.

In general, embodiments of the invention may be implemented in connection with systems, software, and components, that individually and/or collectively implement, and/or cause the implementation of, data protection operations which may include, but are not limited to, data replication operations, IO replication operations, data read/write/delete operations, data deduplication operations, data backup operations, data restore operations, data cloning operations, data archiving operations, and disaster recovery operations. More generally, the scope of the invention embraces any operating environment in which the disclosed concepts may be useful.

New and/or modified data collected and/or generated in connection with some embodiments, may be stored in a data environment that may take the form of a public or private cloud storage environment, an on-premises storage environment, and hybrid storage environments that include public and private elements. Any of these example storage environments, may be partly, or completely, virtualized.

Example cloud computing environments, which may or may not be public, include storage environments that may provide data protection functionality for one or more clients. Another example of a cloud computing environment is one in which processing, data protection, and other, services may be performed on behalf of one or more clients. Some example cloud computing environments in connection with which embodiments of the invention may be employed include, but are not limited to, Microsoft Azure, Amazon AWS, Dell EMC Cloud Storage Services, and Google Cloud. More generally however, the scope of the invention is not limited to employment of any particular type or implementation of cloud computing environment.

In addition to the cloud environment, the operating environment may also include one or more clients that are capable of collecting, modifying, and creating, data. As such, a particular client (e.g., a device, an edge device or server, a cloud server) or engine may employ, or otherwise be associated with, one or more instances of each of one or more applications that perform such operations with respect to data. Such clients may comprise physical machines, or virtual machines (VM), or containers.

It is noted that any of the disclosed processes, operations, methods, and/or any portion of any of these, may be performed in response to, as a result of, and/or, based upon, the performance of any preceding process(es), methods, and/or, operations. Correspondingly, performance of one or more processes, for example, may be a predicate or trigger to subsequent performance of one or more additional processes, operations, and/or methods. Thus, for example, the various processes that may make up a method may be linked together or otherwise associated with each other by way of relations such as the examples just noted. Finally, and while it is not required, the individual processes that make up the various example methods disclosed herein are, in some embodiments, performed in the specific sequence recited in those examples. In other embodiments, the individual processes that make up a disclosed method may be performed in a sequence other than the specific sequence recited.

Following are some further example embodiments of the invention. These are presented only by way of example and are not intended to limit the scope of the invention in any way.

Embodiment 1. A method, comprising: receiving sound information from a distributed microphone array that includes microphone arrays in an environment by an orchestration engine, wherein each of the microphone arrays is associated with a corresponding device and a corresponding user and wherein the distributed microphone array receives sound from the environment, generating adjustments for each of the microphone arrays based on the sound information, and providing the adjustments to the microphone arrays, wherein the adjustments are configured to improve at least noise suppression.

Embodiment 2. The method of embodiment 1, wherein the adjustments are further configured to improve speech intelligibility.

Embodiment 3. The method of embodiment 1 and/or 2, further comprising performing sound localization and sound extraction on the sound information and generating a sound map.

Embodiment 4. The method of embodiment 1, 2, and/or 3, wherein the adjustments are customized for each of the microphone arrays.

Embodiment 5. The method of embodiment 1, 2, 3, and/or 4, further comprising synchronizing the sound information such that the sound information from each of the microphone arrays synchronized, wherein synchronizing includes accounting for delays including at least time or arrival delays, onset time delays, and internal microphone array delays.

Embodiment 6. The method of embodiment 1, 2, 3, 4, and/or 5, wherein the adjustments include adjustments to array parameters and an anti-noise signal.

Embodiment 7. The method of embodiment 1, 2, 3, 4, 5, and/or 6, wherein the adjustments include positioning speakers that generate speech for the users.

Embodiment 8. The method of embodiment 1, 2, 3, 4, 5, 6, and/or 7, further comprising identifying a sound source of interest for each of the users, wherein the adjustments are configured to suppress noise for each of the users while improving the sound source of interest for each of the users.

Embodiment 9. The method of embodiment 1, 2, 3, 4, 5, 6, 7, and/or 8, further comprising sound source localization using one or more of direction of arrival, time difference of arrival, interaural time difference, interaural level differences, or deep learning.

Embodiment 10. The method of embodiment 1, 2, 3, 4, 5, 6, 7, 8, and/or 9, further comprising controlling a number of the microphone arrays that are used to generate the adjustments, wherein the orchestration engine is implemented in the devices or in an edge server, or in a cloud server.

Embodiment 11. A method for performing any of the operations, methods, or processes, or any portion of any of these, or any combination disclosed herein.

Embodiment 12. A non-transitory storage medium having stored therein instructions that are executable by one or more hardware processors to perform operations comprising the operations of any one or more of embodiments 1 through 11.

The embodiments disclosed herein may include the use of a special purpose or general-purpose computer including various computer hardware or software modules, as discussed in greater detail below. A computer may include a processor and computer storage media carrying instructions that, when executed by the processor and/or caused to be executed by the processor, perform any one or more of the methods disclosed herein, or any part(s) of any method disclosed.

As indicated above, embodiments within the scope of the present invention also include computer storage media, which are physical media for carrying or having computer-executable instructions or data structures stored thereon. Such computer storage media may be any available physical media that may be accessed by a general purpose or special purpose computer.

By way of example, and not limitation, such computer storage media may comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which may be used to store program code in the form of computer-executable instructions or data structures, which may be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which, when executed, cause a general purpose computer, special purpose computer, or special purpose processing device to perform a certain function or group of functions. As such, some embodiments of the invention may be downloadable to one or more systems or devices, for example, from a website, mesh topology, or other source. As well, the scope of the invention embraces any hardware system or device that comprises an instance of an application that comprises the disclosed executable instructions.

Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' or 'engine' may refer to software objects or routines that execute on the computing system. The different components, modules, engines, and services described herein may be implemented as objects or processes that execute on the computing system, for example, as separate threads. While the system and methods described herein may be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention may be performed in client-server environments, whether network or local environments, or in any other suitable environment. Suitable operating environments for at least some embodiments of the invention include cloud computing environments where one or more of a client, server, or other machine may reside and operate in a cloud environment.

Figure 4:
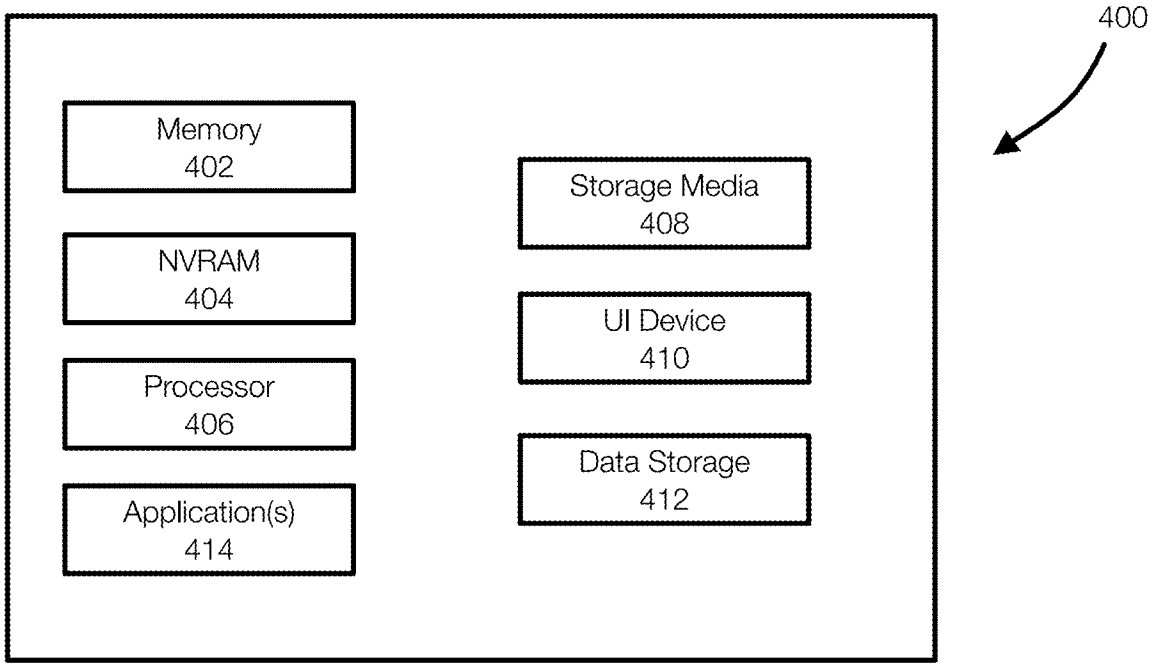
FIG. 4 discloses aspects of a computing device or a computing system.

With reference briefly now to FIG. 4, any one or more of the entities disclosed, or implied, in the Figures and/or elsewhere herein, may take the form of, or include, or be implemented on, or hosted by, a physical computing device, one example of which is denoted at 400. As well, where any of the aforementioned elements comprise or consist of a virtual machine (VM), that VM may constitute a virtualization of any combination of the physical components disclosed in FIG. 4.

In the example of FIG. 4, the physical computing device 400 includes a memory 602 which may include one, some, or all, of random access memory (RAM), non-volatile memory (NVM) 404 such as NVRAM for example, read-only memory (ROM), and persistent memory, one or more hardware processors 406, non-transitory storage media 408, UI device 410, and data storage 412. One or more of the memory components 402 of the physical computing device 400 may take the form of solid state device (SSD) storage. As well, one or more applications 400 may be provided that comprise instructions executable by one or more hardware processors 406 to perform any of the operations, or portions thereof, disclosed herein.

Such executable instructions may take various forms including, for example, instructions executable to perform any method or portion thereof disclosed herein, and/or executable by/at any of a storage site, whether on-premises at an enterprise, or a cloud computing site, client, datacenter, data protection site including a cloud storage site, or backup server, to perform any of the functions disclosed herein. As well, such instructions may be executable to perform any of the other operations and methods, and any portions thereof, disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method, comprising:

receiving sound information from a distributed microphone array that includes microphone arrays in an environment by an orchestration engine, wherein each of the microphone arrays is associated with a corresponding device and a corresponding user and wherein the distributed microphone array receives sound from the environment;

generating, by the orchestration engine, adjustments for each of the microphone arrays based on the sound information; and providing, by the orchestration engine, the adjustments to the microphone arrays, wherein the adjustments are configured to improve at least noise suppression.

2. The method of claim 1, wherein the adjustments are further configured to improve speech intelligibility.

3. The method of claim 1, further comprising performing sound localization and sound extraction on the sound information and generating a sound map.

4. The method of claim 1, wherein the adjustments are customized for each of the microphone arrays.

5. The method of claim 1, further comprising synchronizing the sound information such that the sound information from each of the microphone arrays synchronized, wherein synchronizing includes accounting for delays including at least time or arrival delays, onset time delays, and internal microphone array delays.

6. The method of claim 1, wherein the adjustments include adjustments to array parameters and an anti-noise signal.

7. The method of claim 1, wherein the adjustments include positioning speakers that generate speech for the users.

8. The method of claim 1, further comprising identifying a sound source of interest for each of the users, wherein the adjustments are configured to suppress noise for each of the users while improving the sound source of interest for each of the users.

9. The method of claim 1, further comprising sound source localization using one or more of direction of arrival, time difference of arrival, interaural time difference, interaural level differences, or deep learning.

10. The method of claim 1, further comprising controlling a number of the microphone arrays that are used to generate the adjustments, wherein the orchestration engine is implemented in the devices or in an edge server, or in a cloud server.

11. A non-transitory storage medium having stored therein instructions that are executable by one or more hardware processors to perform operations comprising:

receiving sound information from a distributed microphone array that includes microphone arrays in an environment by an orchestration engine, wherein each of the microphone arrays is associated with a corresponding device and a corresponding user and wherein the distributed microphone array receives sound from the environment;

generating, by the orchestration engine, adjustments for each of the microphone arrays based on the sound information; and providing, by the orchestration engine, the adjustments to the microphone arrays, wherein the adjustments are configured to improve at least noise suppression.

12. The non-transitory storage medium of claim 11, wherein the adjustments are further configured to improve speech intelligibility.

13. The non-transitory storage medium of claim 11, further comprising performing sound localization and sound extraction on the sound information and generating a sound map.

14. The non-transitory storage medium of claim 11, wherein the adjustments are customized for each of the microphone arrays.

15. The non-transitory storage medium of claim 11, further comprising synchronizing the sound information such that the sound information from each of the microphone arrays synchronized, wherein synchronizing includes accounting for delays including at least time or arrival delays, onset time delays, and internal microphone array delays.

16. The non-transitory storage medium of claim 11, wherein the adjustments include adjustments to array parameters and an anti-noise signal.

17. The non-transitory storage medium of claim 11, wherein the adjustments include positioning speakers that generate speech for the users.

18. The non-transitory storage medium of claim 11, further comprising identifying a sound source of interest for each of the users, wherein the adjustments are configured to suppress noise for each of the users while improving the sound source of interest for each of the users.

19. The non-transitory storage medium of claim 11, further comprising sound source localization using one or more of direction of arrival, time difference of arrival, interaural time difference, interaural level differences, or deep learning.

20. The non-transitory storage medium of claim 11, further comprising controlling a number of the microphone arrays that are used to generate the adjustments, wherein the orchestration engine is implemented in the devices or in an edge server, or in a cloud server.

* * * * *